United States Patent [19]

Hambleton

[11] Patent Number: 4,673,126

[45] Date of Patent: Jun. 16, 1987

[54] MOISTURE BARRIER CARTON WITH RECLOSABLE COVER

[75] Inventor: Thomas P. Hambleton, Thompson Ridge, N.Y.

[73] Assignee: International Paper Company, New York, N.Y.

[21] Appl. No.: 884,579

[22] Filed: Jul. 11, 1986

[51] Int. Cl.[4] ..... B65D 5/66; B65D 43/16

[52] U.S. Cl. ..... 229/43; 206/607; 206/621; 206/626; 206/628; 220/258; 229/7 R

[58] Field of Search ..... 229/7 R, 17 R, 43; 206/607, 611, 620, 621, 626, 628; 220/258, 259

[56] References Cited

U.S. PATENT DOCUMENTS

| | | | |
|---|---|---|---|
| 2,343,222 | 2/1944 | Nelson | 206/629 |
| 3,274,964 | 9/1966 | Griese, Jr. | 229/43 |
| 3,391,852 | 7/1968 | Waldrop | 229/43 |
| 3,951,331 | 4/1976 | Smith et al. | 220/258 |
| 4,127,187 | 11/1978 | Smith | 220/258 |
| 4,358,025 | 11/1982 | Urion | 220/258 |
| 4,433,808 | 2/1984 | Gordon et al. | 229/43 |
| 4,556,152 | 12/1985 | Bogren | 220/258 |
| 4,562,936 | 1/1986 | Deflander | 220/258 |
| 4,583,679 | 4/1986 | Johnson | 229/7 R |

FOREIGN PATENT DOCUMENTS

| | | | |
|---|---|---|---|
| 2039366 | 2/1972 | Fed. Rep. of Germany | 229/43 |
| 248902 | 3/1926 | United Kingdom | 229/43 |

*Primary Examiner*—Stephen Marcus
*Assistant Examiner*—Gary E. Elkins
*Attorney, Agent, or Firm*—W. T. Zielinski

[57] ABSTRACT

An open ended carton which includes a recessed moisture barrier closure provided by a membrane liner and an overlying cover. The membrane liner includes a perforated cut-out area which defines a pour spout. The cover which is affixed to the cut-out area by a heat seal pivots outwardly about a transverse score line to sever the perforations. Areas in the cover which surround the cut-out perforations in the membrane are releasably sealed to the membrane, such that outward pivoting of the cover severs the perforations and peels the seal open to provide a pour spout.

14 Claims, 14 Drawing Figures

FIG. 10
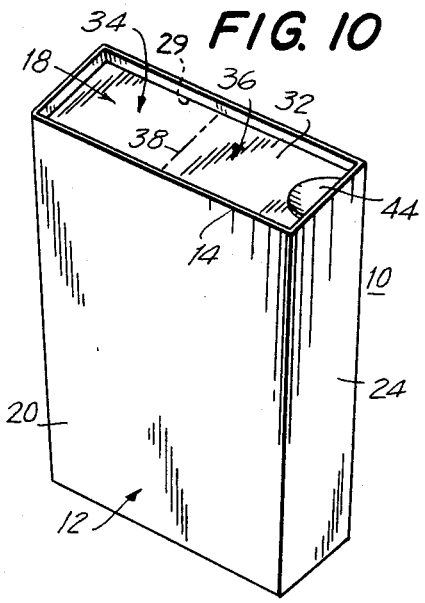
FIG. 11
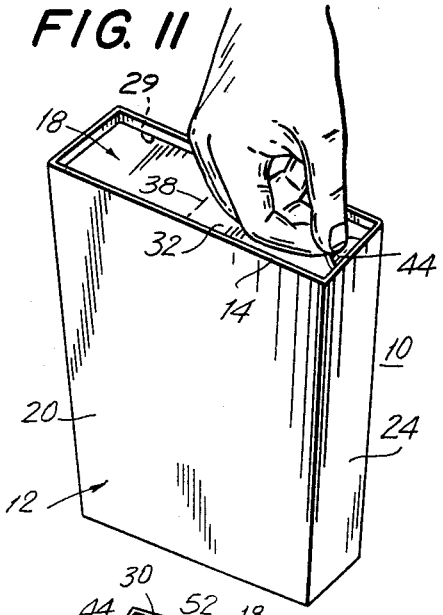
FIG. 12
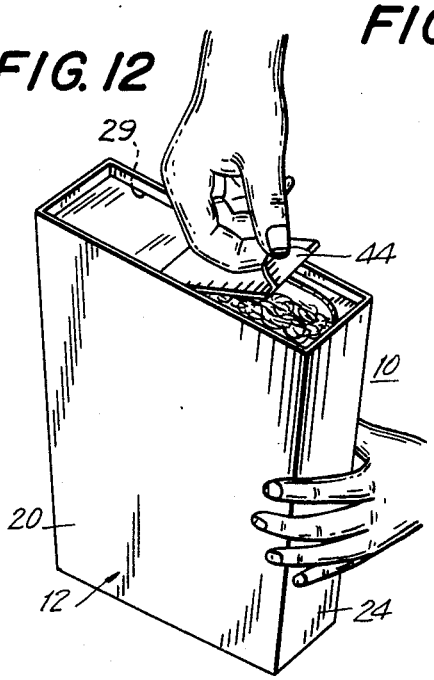
FIG. 13
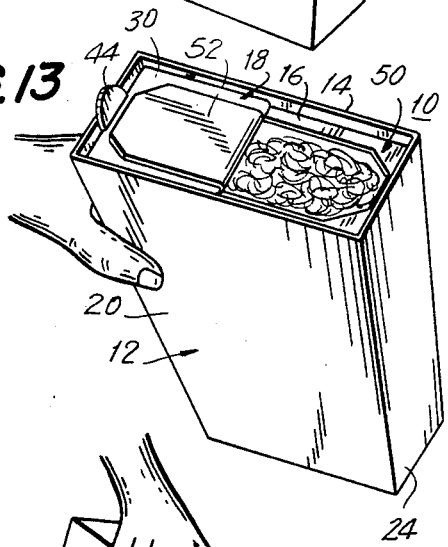
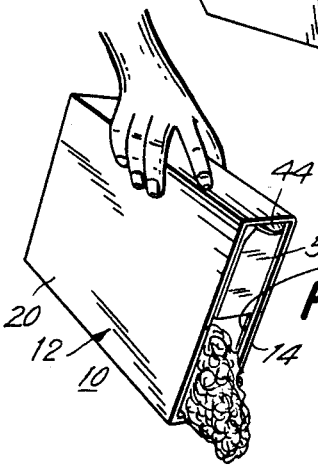
FIG. 14

MOISTURE BARRIER CARTON WITH RECLOSABLE COVER

FIELD OF INVENTION

This invention generally relates to moisture barrier carton constructions and, more particularly, a carton including a perforated tear-out panel which provides a reclosable pour spout.

BACKGROUND ART

In packaging granulated or pulverized food products and products having sifting characteristics, it has been customary in the food industry to employ cartons provided with pouch liners formed from moisture impervious papers, foils or plastics. Such pouch liners typically have ends which are fused by heat to form closure ridges or fins. Once opened, the carton is resealed by folding or rolling the open ends of the inner pouch.

In order to effect cost savings in material and production machinery, and extended product shelf life, the packaging industry has developed and marketed linerless cartons provided with thermoplastic moisture-proof coatings and barrier closures. This approach is exemplified by U.S. Pat. Nos. 2,795,364 and 2,886,231, both to B. Benzon-Petersen, which are directed to cartons having rectangular parallelepiped configurations and a closure formed by hingedly attached and overlapping closure flaps. A barrier seal is obtained by attaching a sealing membrane to the flaps when they are oriented in an outward direction prior to their closure. However, this structure does not provide a moisture barrier once the membrane seal is broken limiting the usefulness of the package.

An alternative carton arrangement is disclosed in U.S. Pat. No. 3,190,531 to Holmstrom, which shows a membrane sealing sheet attached to interior surfaces of carton closure flaps. In order to provide a resealing feature, the membrane is attached to one flap at areas which outline an inwardly oriented U-shaped arch, and a sidewall panel adjoining the flap is provided with crease lines which form a spout. The spout is provided by severing the sealed bottom end of the U-shaped arch to define an opening to the interior of the carton, see FIGS. 1–3. The container is resealed by folding the flap across the opening in the container and interlocking the closure flaps.

Another approach of the prior art, represented by U.S. Pat. No 2,719,663 to G. Meyer-Jagenberg, shows a carton cover structure including an aperture flap having an incised cut area and an overlying covering flap which is attached to the aperture flap by an adhesive coating. Outward pivoting of the covering flap effects severance of the incised area to define a pour spout. The cover is reclosed by pressing the covering flap into adhesive contact with areas surrounding the pour spout. The closure is recessed within the carton and secured in position by overlying peripheral flanges in the covering and aperture flaps which form a U-shaped surface for attachment to an upper end of the carton body. See FIG. 7.

Difficulty with the recessed cover structure in Jagenberg is presented by the arrangement of attachment flanges which require complicated folding operations during assemblage. Further difficulties are associated with the adhesive bond between the aperture and covering flaps which limit the effectiveness of release and reseal features in the cover.

The present invention is directed to an improved linerless carton having a recessed sealing membrane and resealing structure of uncomplex design and enhanced effectiveness over prior art pouch and adhesive closures. The invention advances known moisture barrier closures by incorporating a reclosable pour spout structure which functions without requirement of an adhesive bond. It will be appreciated that linerless cartons provide cost savings in materials and manufacturing efficiencies over pouch arrangements, and that a reclosable moisture barrier carton with an effective dispensing spout will meet a need of the packaging art.

Accordingly, it is the broad object of the present invention to provide an improved moisture barrier carton of economical design which is easily opened and resealed by the consumer.

A more specific object of the invention is to provide a linerless carton incorporating a closure membrane which obtains a moisture barrier seal improved over the prior art.

A still further object of the invention is to provide a moisture barrier closure which includes a pour spout for dispensing foodstuff.

DISCLOSURE OF THE INVENTION

In the present invention, these purposes, as well as others which will be apparent, are achieved generally by providing an open ended carton including a moisture barrier membrane liner which seals the carton opening. The carton includes an upright boundary wall having a top end peripheral edge which defines the carton opening, and a cover including first and second hingedly connected sections. The membrane liner includes a central area, a peripheral flange extending outwardly from the central area, and a perforated cut-out area located in the central area which defines a pour spout. A moisture barrier closure is provided by attachment of the cover to the membrane which in turn is sealed at the peripheral flange to the carton opening. The first cover section is heat sealed to the membrane; the second section overlies and is heat sealed to areas within the cut-out perforations. Areas in the second section of the cover which surround the cut-out perforations in the membrane are releasably sealed to the membrane, such that outward pivoting of the second section severs the perforations and peels the seal open to provide a pour spout feature.

In a preferred embodiment of the invention, the carton has a generally parallelepiped configuration and includes a peripheral flange at the open end which folds inwardly and overlaps the membrane flange to effect a recessed attachment of the cover and membrane. The cover pivots outwardly through substantially 180 degrees, such that it overlies the first section to provide access to the pour spout. For further advantage, the second section is dimensioned to frictionally engage the peripheral flange, so that the cover may be locked in open and closed positions after the pour spout perforations are broken. In this preferred embodiment the carton includes a milk carton style bottom end closure.

Other objects, features and advantages of the present invention will be apparent when the detailed description of the preferred embodiments of the invention are considered in conjunction with the drawings which should be construed in an illustrative and not limiting sense as follows:

BRIEF DESCRIPTION OF THE DRAWINGS

FIGS. 10–14 show the manner in which the cover pivots about a central transverse score line and is secured in open and closed positions by frictional engagement with a peripheral flange in the open top end of the carton.

BEST MODE FOR CARRYING OUT THE INVENTION

Figure 1:
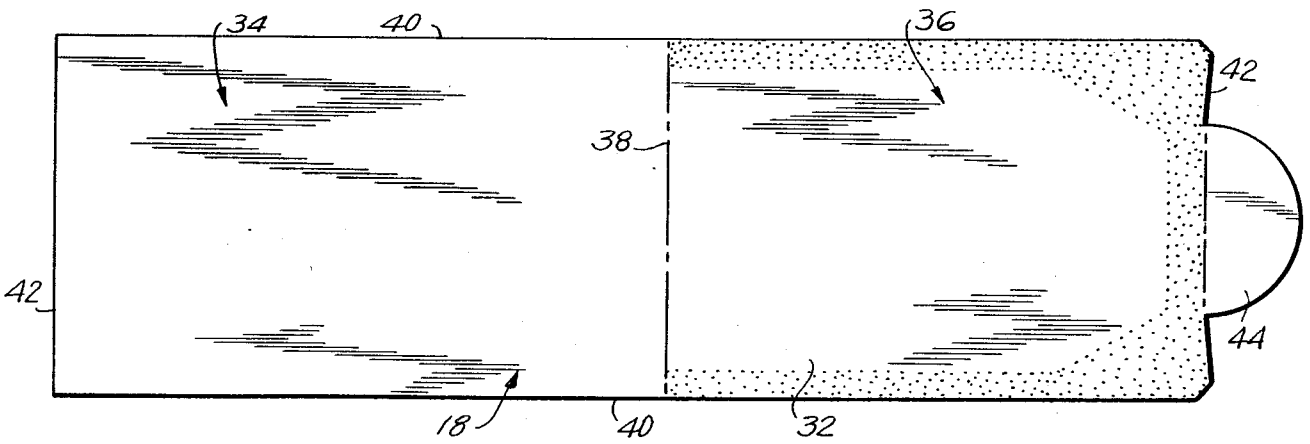
FIG. 1 is a plan view of a blank cut and scored to form a cover for a moisture barrier carton of the present invention.
Figure 2:
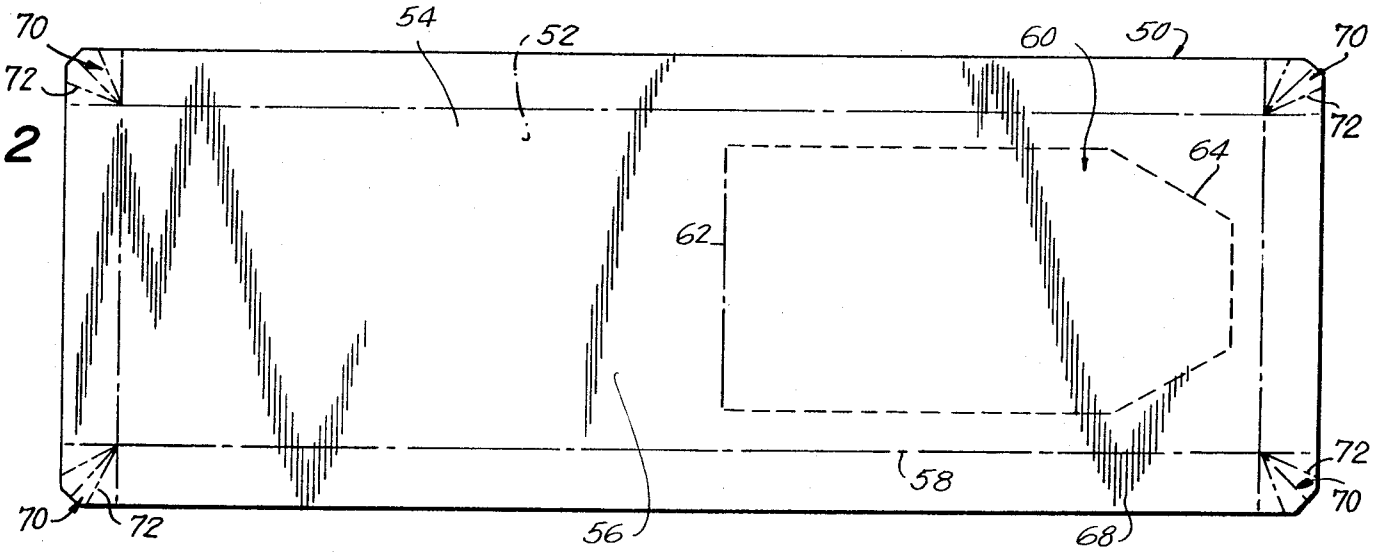
FIG. 2 is a plan view of a moisture-proof membrane liner which is scored for attached to the cover to form a moisture barrier closure.
Figure 4:
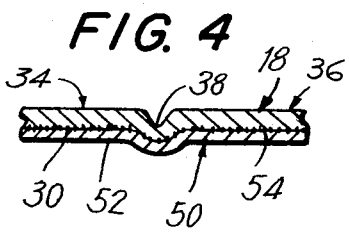
FIG. 4 is a horizontal cross-sectional view of the carton taken along the line 4—4 of FIG. 3.
Figure 5:
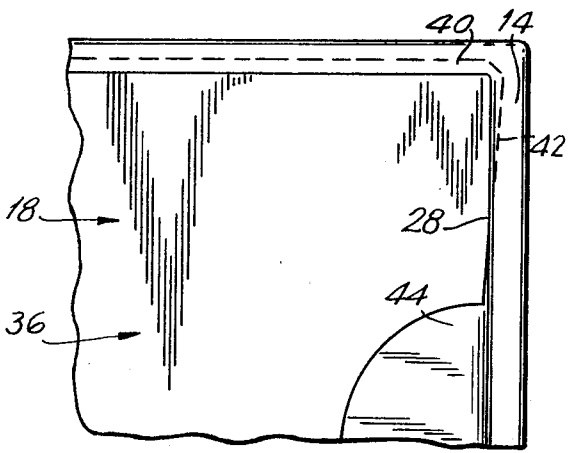
FIG. 5 is a horizontal cross-sectional view of the carton taken along the line 5—5 of FIG. 3.

Referring now to the drawings, a carton, generally designated 10, including a reclosable moisture barrier membrane liner 50 is shown in FIGS. 1–8 and 10–14. The carton 10 is formed from a blank, illustrated in FIG. 9, which will be described following a discussion of the carton construction.

The carton 10 is preferably fabricated of a high moisture barrier polymer extrusion coated folding carton paperboard, for example, paperboard having an exterior coating of 10 lb. low density polyethene and interior coatings of 30 lb. high density and overlying 10 lb. low density polyethene, such coatings being per 3000 sq. ft. of board. The carton includes a body portion formed by an upright boundary wall 12, a top end peripheral edge 14 which defines a carton opening 16, and a cover 18 for closing the top end of the carton. In the preferred embodiment, the boundary wall has a generally parallelepiped configuration including front 20, rear 22, side 24, and bottom 26 wall sections, and a first flange 28 which is hingedly attached to the peripheral edge. The first flange 28 has a terminal edge 29, see FIG. 6.

The cover 18 includes interior and exterior surfaces 30, 32, and first and second sections 34, 36 which are hingedly attached at a central transverse line 38. See FIG. 1. The cover also includes longitudinal and transverse boundary edges 40, 42, and a tab 44 which is hingedly connected to the transverse edge 42 in the second section. As will be described hereinafter, the tab 44 is employed to pivot the second section 36 outwardly for access to the carton interior.

According to the invention, a moisture barrier closure of the carton is obtained by employment of a membrane liner 50 which may be fabricated of a moisture-proof coated paper, plastic or foil having specifications conventionally known in the art. For reasons which be described below, the membrane 50 has a thickness of less than 10 mils and preferably in the range of 6–8 mils.

The membrane liner 50 which has a rectangular configuration includes interior and exterior sides 52, 54, a central area 56 bounded by a scored central edge 58 having substantially the same dimension as the cover 18, and a perforated cut-out area 60 located in the central area 56 defined by rear and connecting perforation lines 62, 64 which provides a pour spout 66. The membrane 50 also includes a second peripheral flange 68 which extends outwardly from the central edge 58. Corners 70 in the membrane liner include multiple angular score lines 72 to facilitate folding of the peripheral flange 68 about perforation lines 62, 64. See FIG. 2.

A preferred membrane liner 50 is fabricated of a 50 lb. per 3000 sq. ft. bleached machine finished kraft paper which is coated on its interior side with a PVDC emulsion to effect a moisture barrier closure of the carton. The exterior side 54 of the membrane and the interior surface of the cover 30 are extrusion coated with polyethene film so that they may be heat sealed together.

A moisture barrier closure is provided by affixing the cover 18 to the membrane 50 which in turn is sealed to the carton opening 16. As shown in FIGS. 4–7, the cover 18 overlies the central area 56 of the membrane 50 with the transverse score and rear perforation lines 38, 62 of the respective members arranged in aligned and overlying relation.

Figure 6:
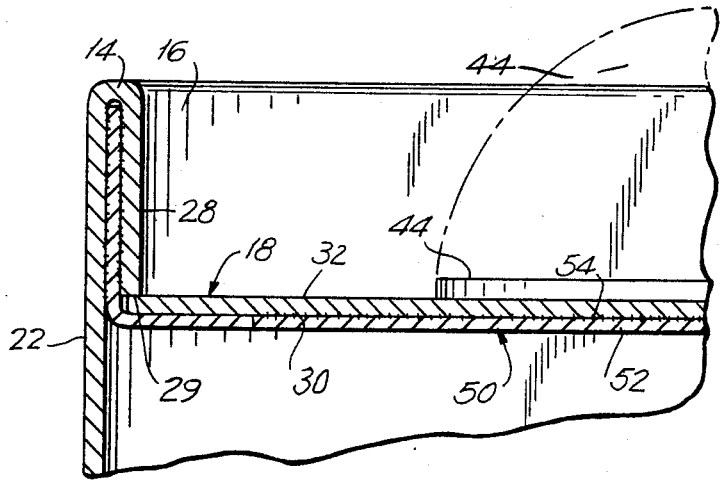
FIG. 6 is a horizontal cross-sectional view of the carton taken along the line 6—6 of FIG. 3.

The second peripheral flange 68 is folded upward and oriented at approximately a right angle with respect to the longitudinal and transverse boundary edges 40, 42 of the cover, and secured to the carton opening by overlapping attachment of the first peripheral carton flange 28, see FIG. 6. A moisture barrier attachment of the membrane to the carton is readily effected by heat sealing the first and second flanges 28, 68 to the carton boundary wall 12. An effective heat seal is assured by use of a relatively thin membrane liner 50 and multiple corner score lines 72. Combination of the thin membrane and cover provides a structurally rigid closure which is readily heat sealed to the carton opening.

It will be recognized by those skilled in the art that the recessed cover and membrane closure of the invention is less complex than prior art recessed covers which employ multiple folding flanges, see e.g., U.S. Pat. No. 2,719,663 to G. Meyer-Jagenberg. Advantageously, the heat sealed recessed closure of the invention imparts structural rigidity to the top end of the carton permitting use of paper of lesser caliber thickness for cost efficiencies. For example, in conventional cereal boxes paperboard having a thickness of 0.020" is required; the recessed closure permits use of paperboard having a thickness in the range of 0.016".

Figure 7:
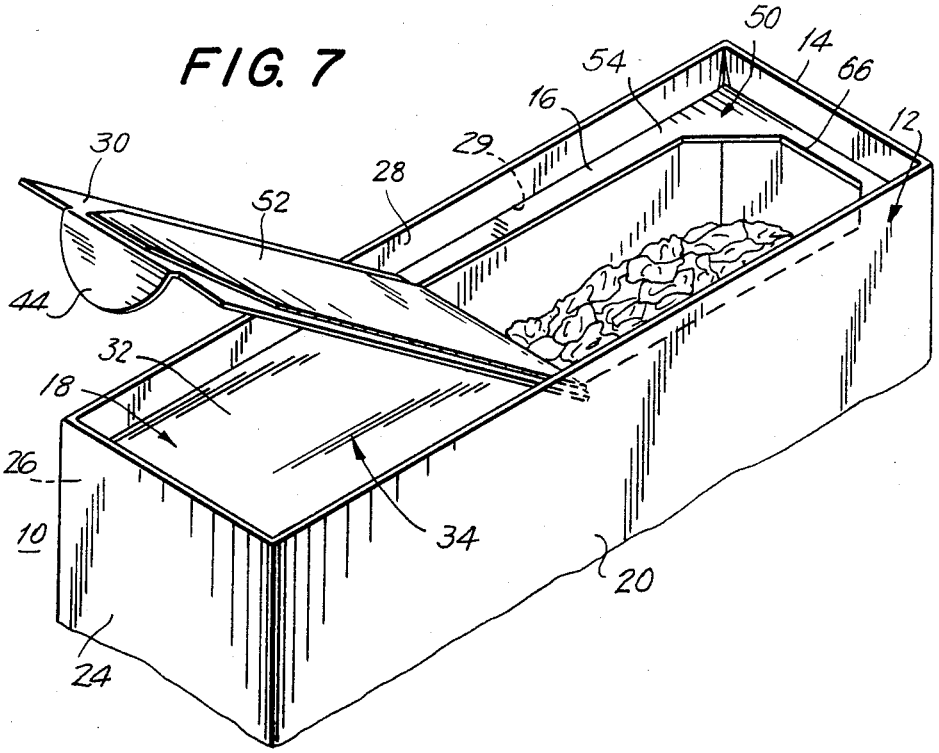
FIG. 7 shows the manner in which the moisture barrier closure folds outwardly to provide a dispensing spout.

Attention is now directed to the pour spout 66 feature of the carton closure. As shown in FIGS. 6 and 7, the entire interior surface 30 of the first and second sections are heat sealed to the exterior side 54 of the membrane. However, areas in the second section 36 which surround the cut-out area 60 are coated with a formulated microcrystalline wax to facilitate severance of the seal.

Figure 3:
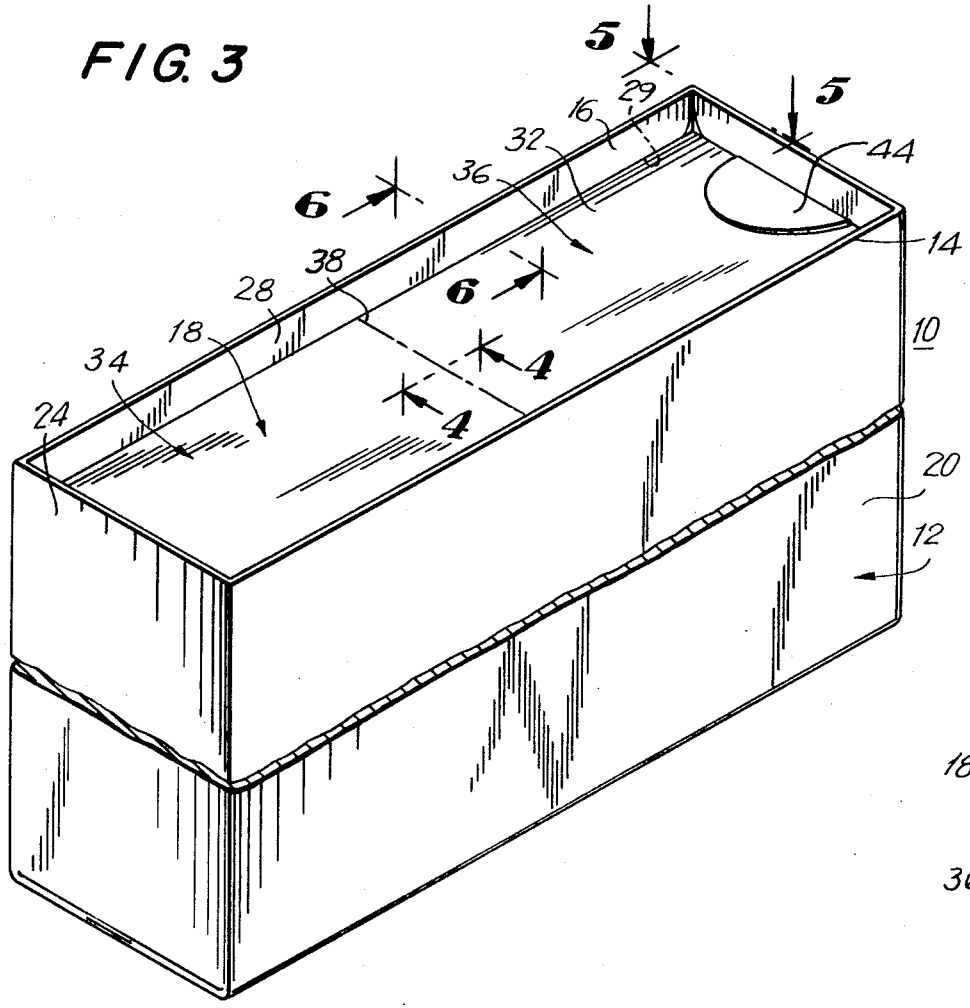
FIG. 3 is a perspective view of a rectangular parallelepiped carton according to the invention including a moisture barrier closure.

This arrangement maintains the liner 50 in aligned relation with the carton opening 16, as shown in FIG. 3, and facilitates pivotal movement of the second section 36 about transverse score line 38 to provide a pour spout 66.

Advantageously, the second section 36 pivots outwardly through substantially 180 degrees such that it overlies the first section 34 to provide access to the pour spout. For further advantage, the second section 36 is dimensioned so that boundary edges 40, 42 frictionally engage and are received under the infolded first flange 28 in the carton opening. As shown in FIGS. 10–14 the cover is readily positioned in engagement with the flange 28 in open and closed orientations without requirement of an adhesive. The boundary edges 40, 42 of the cover frictionally engage and are received under terminal edge 29 of the infolded first flange 28 in the carton opening to effect reclosure of the cover without requirement of adhesive. See FIGS. 5 and 6.

FIGS. 10 and 11 illustrate the manner in which the tab 44 is employed to pivot the cover outwardly. The tab is preferably glued or otherwise secured to the carton cover 18 prior to opening to provide a tamper resistance feature.

Figure 8:
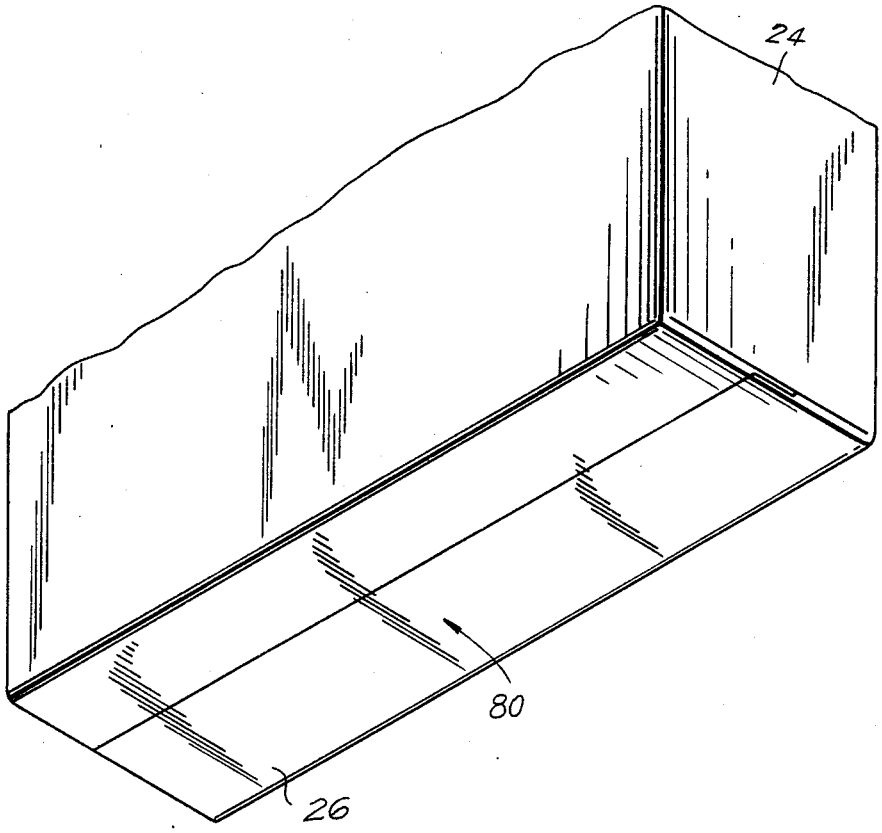
FIG. 8 shows a perspective view of a bottom end milk carton style closure employed in the carton.

Turning to FIG. 8, it will be seen that the carton 10 includes a conventional milk box style bottom end closure. Such conventional closures are shown in U.S. Pat. Nos. 3,120,335 and 3,120,333. The membrane liner 50 with attached cover 18 and milk box closure 80 coact to provide a moisture barrier carton without requirement of conventional pouch arrangements effecting cost savings.

Figure 9:
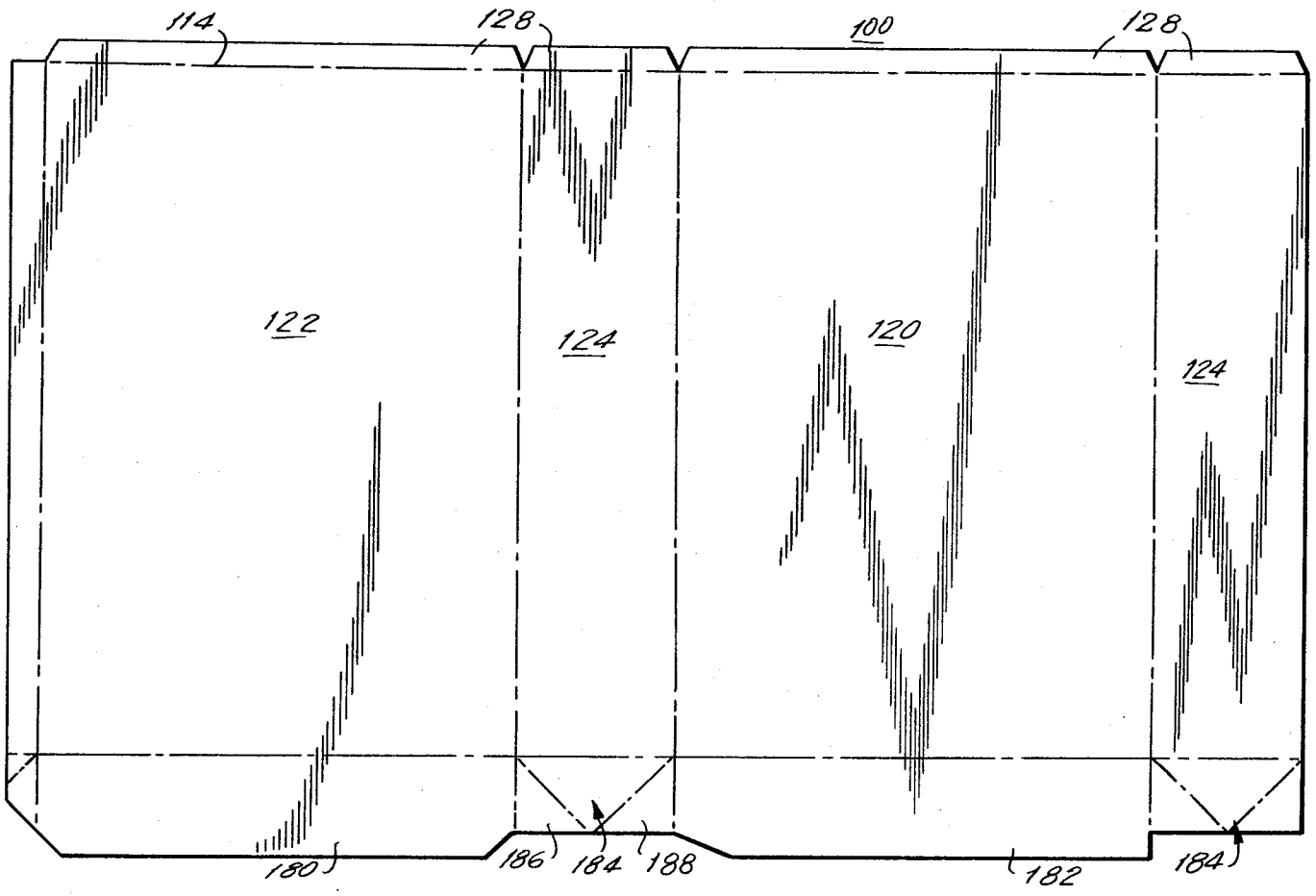
FIG. 9 is a plan view of a carton blank for forming the carton of FIGS. 1–8.

A carton blank for forming the carton of the invention, generally designated 100, is illustrated in FIG. 9. Attention is directed to the arrangement of first flange flaps 128 which are hingedly attached to carton body sections 122–126 at a top end peripheral edge 114. The milk style bottom closure is formed by overlapping longitudinal base panels 180, 182, and inwardly folding side panels 184 which include sections 186, 188.

From the foregoing, it will be appreciated that the present invention provides a moisture barrier reclosable carton 10 which achieves the objects stated heretofore. In particular, a carton 10 is provided which includes a moisture impervious membrane liner 50 which coacts with a cover to obtain a reclosable moisture barrier seal. The membrane liner 50 includes a perforated cut-out area 60 which is readily severed to provide a pour spout. Advantageously, the perforated cut-out and hingedly affixed cover coact to provide a moisture barrier seal which is easily opened and closed by the consumer. A high integrity moisture barrier reclosure is assured by frictional positioning of the cover in the opening.

Numerous modifications are possible in light of the above disclosure. For example, the drawings show a carton having a generally parallelepiped configuration. It will be appreciated that other carton configurations are within the scope of the disclosure. Similarly, in the preferred embodiment the closure is recessed in the carton opening, the perforated pour spout structure of the closure may also be incorporated in flat top cartons.

Therefore, although the invention has been described with reference to certain preferred embodiments, it will be appreciated that other carton constructions may be devised, which are nevertheless within the scope and spirit of the invention as defined by the claims appended hereto.

I claim:

1. A carton which comprises: an open ended body portion formed by an upright boundary wall, and a top end peripheral edge which define the carton opening; a first flange at the peripheral edge; a cover having an interior surface, first and second attachment section which are hingedly connected by a transverse score line, and release means for pivotal movement of said second attachment section about the transverse score line, said cover having a dimension substantially equal to that of the carton opening; and a membrane liner including interior and exterior sides, a central area bounded by a central edge having substantially the same dimension as the cover, a perforated cut out area located in said central area which defines a pour spout, and means for securing the membrane to the carton, said means for securing the membrane to the carton including a second flange which extends outwardly from the central edge, said first flange being folded inwardly and overlapping said seocnd flange to effect a recessed attachment of said membrane and cover to the carton, said cut-out area being defined by rear and connecting boundary perforation lines, said interior surface of said cover being disposed in overlying relation with respect to said central area with said rear perforation and transverse score lines substantially coinciding, said first section being affixed to said membrane, said second attachment section overlying and being affixed to said cut-out area, so that said second attachment section is maintained in closed orientation with respect to said carton opening by the attachment of said cut-out area, readily pivoting outwardly about said transverse line to provide a pour spout when the cut-out area perforations are broken, said second section pivoting through substantially 180 degrees to overlie said first section and releasably engage said first flange to provide unobstructed access to said pour spout, said second section pivoting to overlie said pour spout and releasably engage said first flange to provide a reclosure feature.

2. A carton according to claim 1, wherein said first and second sections are heat sealed to said membrane, areas in said second section surrounding said cut-out area are coated with a formulated microcrystalline wax to facilitate severance of the heat seal, and said first and second flanges are heat sealed to the carton boundary wall.

3. A carton according to claim 2, wherein said membrane liner has a thickness in the range of 6–10 mils to assure an effective heat seal of the membrane and cover to the carton.

4. A carton according to claim 1, wherein said cover includes an exterior surface, and a boundary edge, and said release means includes a tab attached to a portion of the boundar edge in said second section.

5. A carton according to claim 4, wherein said tab is attached to the exterior surface of the cover prior to severance of the cut-out perforations.

6. A carton according to claim 1, wherein said membrane liner is moisture impervious.

7. A carton according to claim 3, wherein, said membrane liner is 50 lb. per 3000 sq. ft. bleached machine finished kraft paper, said interior liner side is coated with PVDC emulsion and said exterior liner side has an extrusion coating of polyethene film.

8. A carton according to claim 6, wherein the body portion has a generally parallelepiped configuration and the boundary wall includes front, rear and side wall sections, and the cover has a rectangular configuration.

9. A carton according to claim 8, wherein the carton includes a milk carton style bottom end closure.

10. A carton having a parallelepiped configuration which comprises: an open ended body portion including front, rear and side wall sections, a top end peripheral edge which defines the carton opening, and a first flange hingedly connected to said peripheral edge; a cover including an interior surface, first and second sections which are hingedly connected by a transverse score line, and release means for pivotal movement of said second section about the transverse score line, said cover having a dimension substantially equal to that of the carton opening; and a membrane liner including interior and exterior sides, a central area having substantially the same direction as the cover and a second peripheral flange defined by a peripheral score line, a perforated cut-out area located in said central area which defines a pour spout, said cut-out area being defined by rear and connecting boundary perforation lines, said interior surface of said cover being disposed in overlying relation with respect to said central area with said reasr perforation and transverse score lines substantially coinciding, said first section being heat sealed to the membrane, said second section overlying and being heat selaed to said cut-out area, areas in said second section surrounding said cut-out area being coated with a formulated microcrystalline wax to facilitate severance of the heat seal, said first flange being folded inwardly and overlying said second flange to effect a recessed moisture barrier attachment of said membrane and cover to the carton, said first and second flanges being heat selaed to the carton boundary wall, said second section being pivotable through substantially 180 degrees to overlie and first section and releasably engage said first flange to provide unobstructed access to said pour spout, said secocnd section pivoting to overlie said pour spout and releasably engage said first flange to provide a reclosure feature, whereby said second section is maintained in closed orientation with respect to said carton opening by the attachment of said cut-out area, and readily pivots outwardly about said transverse line to provide a pour spout when the cut-out area perforations are broken.

11. A carton according to claim 10, wherein said cover includes an exterior surface, and a boundary edge, and asid release means includes a tab attached to a portion of the boundary edge in said second section.

12. A carton according to claim 10, wherein said membrane liner has a thickness in the range of 6–8 mils to assure an effective heat seal of the membrane and cover to the carton, said membrane liner further includes corners each having an angular score line therein, and said liner has a thickness in the range of 6–10 mils to assure an effective heat seal of the membrane and cover to the carton, said angular score lines facilitating folding of said membrane corners for attachment to the carton.

13. A carton according to claim 12, wherein said membrane liner is 50 lb. per 3000 sq. ft. bleached machine finished kraft paper, said interior liner side is coated with PVDC emulsion, and said exterior liner side is extrusion coated with a polyethene film.

14. A carton according to claim 13, wherein the carton includes a milk carton style bottom end closure.

* * * * *